United States Patent [19]

Steele

[11] 4,077,403

[45] Mar. 7, 1978

[54] PORTABLE FRAME FOR DOORWAY MOUNTING OF A TRAPEZE BAR

[76] Inventor: Victor Steele, 6311 Yucca St., Hollywood, Calif. 90028

[21] Appl. No.: 672,927

[22] Filed: Apr. 2, 1976

[51] Int. Cl.[2] ..... A61H 1/02

[52] U.S. Cl. ..... 128/75; 272/61; 272/62; 272/112

[58] Field of Search ..... 272/61, 62, 112, 85–92; 128/75, 68, 68.1, 70; 5/101–104; 273/1.5 R

[56] References Cited

U.S. PATENT DOCUMENTS

| | | | |
|---|---|---|---|
| 3,342,484 | 9/1967 | Christensen | 272/112 X |
| 3,593,708 | 7/1971 | Steele | 128/75 |
| 3,722,883 | 3/1973 | O'Dowd | 272/85 |
| 3,841,631 | 10/1974 | Dolan | 273/1.5 R |

FOREIGN PATENT DOCUMENTS

| | | | |
|---|---|---|---|
| 1,117,665 | 2/1956 | France | 272/62 |
| 1,216,347 | 11/1959 | France | 272/62 |
| 805,175 | 5/1951 | Germany | 5/101 |
| 6,600,417 | 7/1967 | Netherlands | 272/62 |

*Primary Examiner*—Paul E. Shapiro

*Attorney, Agent, or Firm*—Sughrue, Rothwell, Mion, Zinn and Macpeak

[57] ABSTRACT

A telescoping frame cross bar is connected at its opposite ends to respective horizontally spaced vertical doorway riser tubes to form a vertical support frame assembly. Straps having their lower ends fixed to a trapeze bar at laterally spaced positions further have hooks at their upper ends to suspend the trapeze bar from the frame cross bar.

4 Claims, 2 Drawing Figures

PORTABLE FRAME FOR DOORWAY MOUNTING OF A TRAPEZE BAR

BACKGROUND OF THE INVENTION

Field of the Invention

The trapeze bar to which the portable doorway mounting frame assembly of the present invention has application, forms the subject matter of U.S. Pat. No. 3,593,708 entitled "Body Suspension Device." The body suspension device comprises a trapeze bar upon which there is rotatably mounted at least one platform having a padded face such that when the face is initially disposed in a vertical position, the upper thighs of the legs of the user may be pressed against the face and if the upper part of the user's body is bent over the bar, the padded platform rotates on the bar to enable the user's body to be swung over the bar until the torso hangs downwardly and being supported by the thighs resting on the platform face. The invention, while permitting the user to exercise, also has great utility in the therapeutic art and is particularly designed to enable the human body to relieve itself of certain mechanical stresses developed through walking, standing sitting erect or in a semi-erect position. Obviously, the device to which the frame assembly of the present invention has application may be employed in the field of acrobatics and permit the user to accomplish various exercises of the acrobatic type.

In order to support the trapeze bar horizontally at approximately waist level, a pair of parallel horizontally spaced vertical support elements are employed in the patented structures which are of equal length, secured at their lower ends to the trapeze bar at axially spaced positions and provided with hooks at their upper ends such that the hooks may be secured to a cross bar which in turn has its ends fixedly mounted to brackets or the like within a building door frame. Alternatively, eyed screws are screwed into the cross beam of a door frame or the like at horizontally spaced positions and the hooks hang from respective eyes. The spaced, parallel, vertical support elements are spaced from each other a distance in excess of the width of the human body in its pelvic region with the hooks at the upper end of the elements permitting the pivotal support or swinging of the horizontal trapeze bar through the vertical support elements about a pivot axis defined by the contact of the hooks either with the cross bar or the screw eyes. The use of a cross bar mounted within a door frame by brackets which are screwed to the vertical beams defining the sides of the door frame or to eyed screws, screwed into the bottom of the door frame cross beam, limits the use of the body suspension device. Since the body suspension device is essentially a portable and transportable assembly, the use of the same is limited to locations where a suitable cross bar at a height in excess of the height of the person employing the same exists, or to a location where the eyed screws are already mounted at a position of acceptable height.

SUMMARY OF THE INVENTION

The present invention relates to a portable doorway mounting frame assembly for a body suspension device comprising a modified trapeze bar and takes the form of a sectional assembly comprising a pair of sectional, vertical doorway riser tubes having means within the upper ends of said riser tubes to receive respective ends of a telescoping frame cross bar to permit the frame assembly to fit different width door frames, the frame cross bar assembly being formed of concentric telescoping tubes with one tube extended relative to the other to permit the vertical doorway riser tubes to be positioned in abutment with opposed vertical door frame beams and to maintain frame assembly stability after expanding the telescoping tubes of the frame cross bar to effect contact abutment between the doorway riser tubes and the doorway vertical beams.

Preferably, the vertical doorway riser tubes are rectangular in configuration and include extender sections terminating at their contacting ends in an arrangement where one tube section has a reduced thickness portion which is insertably received within the open end of the other riser tube section. One or more U-shaped retaining clamps may be fixed to the sides of the door frame vertical beams within which the ends of the trapeze bar or stability extension portions thereof may be inserted to limit swinging of the trapeze bar on the hooked ends of the vertical support elements.

DESCRIPTION OF THE PREFERRED EMBODIMENT

Figure 1:
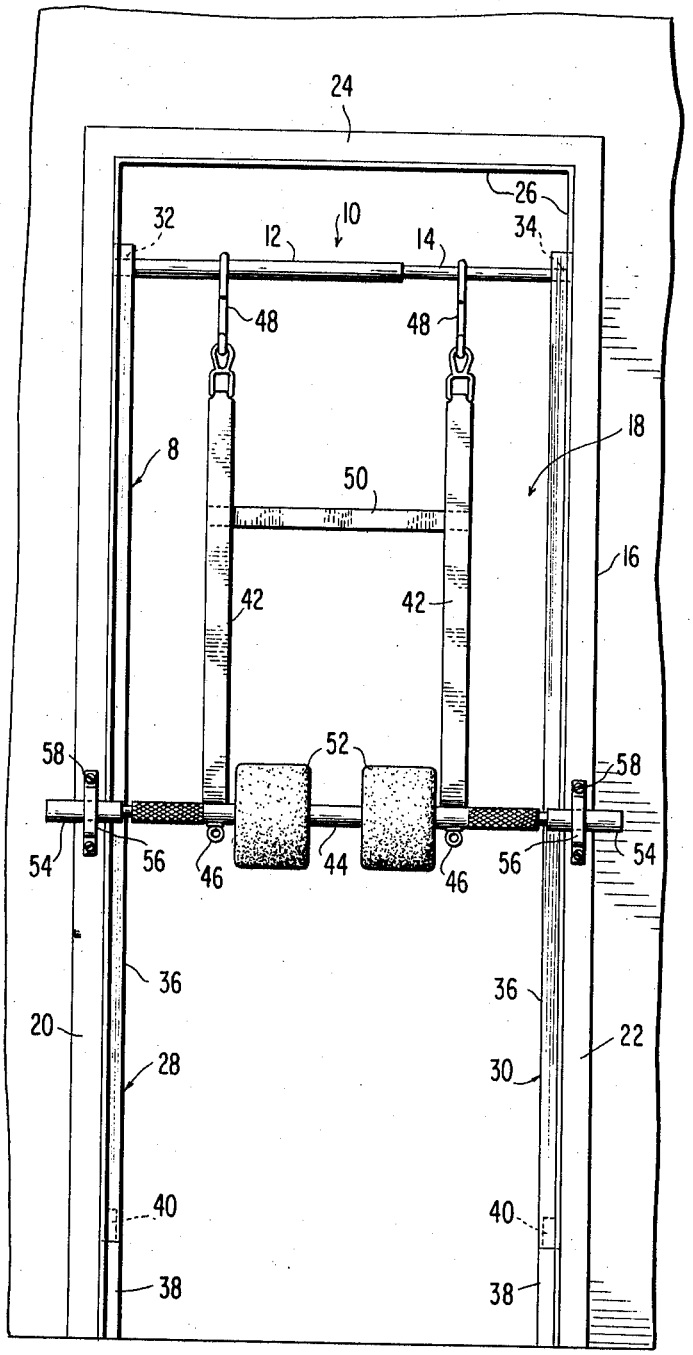
FIG. 1 is an elevational view of a doorway employing the portable frame assembly of the present invention, on which a body suspension device is suspended.
Figure 2:
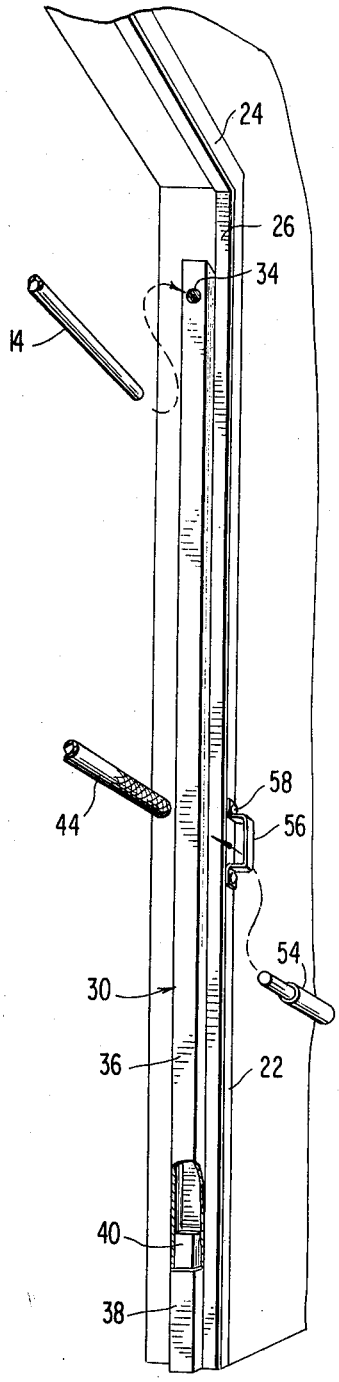
FIG. 2 is an exploded view of a portion of the portable frame assembly of the present invention illustrating the connection of the telescoping frame cross bar to the sectional vertical frame riser tubes and the sections of those tubes.

FIGS. 1 and 2 illustrate in a preferred form the portable doorway mounting frame assembly for a body suspension device in the form of a modified trapeze bar. A telescoping frame cross bar indicated generally at 10 comprises a pair of telescoping tubes 12, 14 which may be formed of steel or other light weight but relatively strong metal. The larger diameter tube is at 12 and the smaller diameter tube at 14. A door frame, indicated generally at 16, for a dwelling or the like defines an opening 18 and comprises a pair of horizontally spaced, vertical, doorframe beams or posts 20 and 22 joined at the top by a cross beam 24. Wooden strips 26 may be provided on the inside faces of the vertical beams 20 and 22 to limit the pivotable movement of a hinged door (not shown). The strips 26 form a portion of the door molding and create thin shoulders which are employed in locating vertical doorway riser tubes 28 and 30 at the left and right sides of the door frame 16, respectively. The portable frame assembly 8 of the present invention comprises essentially the vertical doorway riser tubes 28 and 30 and telescoping frame cross bar 10. The vertical doorway riser tubes 28 and 30 are formed essentially of steel tubes of rectangular configuration in cross section both for strength and for the purpose of permitting the flat sides of the same to abut and extend along the faces of the vertical posts or beams 20 and 22 and the strips 26 forming the door molding. This aids in locating and maintaining the portable frame assembly 8 in place after extending tube 14 with respect to the tube 12 of cross bar 10.

Preferably, cylindrical openings are provided as at 32 and 34 for respective riser tubes 28 and 30 for receiving respectively the ends of tubes 12 and 14 of the frame cross bar 10. Alternatively, notches or slots may be formed within the upper ends of the doorway riser tubes 28 and 30 to permit connection between the telescoping frame cross bar 10 and the doorway riser tubes 28 and 30. In the illustrated embodiment, the doorway riser tubes 28 and 30 comprise in each case two sections, an upper tube section 36 and a lower tube section 38. Each of the lower sections 38 for the respective doorway riser tubes are provided integrally with reduced thickness projection portions or extensions as at 40 which are received within the open lower ends of the upper sections of the vertical doorway riser tube assemblies 28 and 30. Obviously, additional tube sections of a length approximately the same as the sections 38 may be employed to further extend tubes 28 and 30 to increase the height of the telescoping frame cross bar assembly 10 and the suspended height of the trapeze bar carried thereby.

In that respect and in conjunction with the prior body suspension device of U.S. Pat. No. 3,593,708, a pair of straps constituting the vertical support elements permit the horizontal suspenion of a trapeze bar 44. The straps 42 are mechanically fixed by eye bolts 46 at their lower ends to the trapeze bar 44 at horizontally spaced positions. The straps 42 fixed to the bar extend upwardly therefrom laterally spaced slightly greater than the waist dimension of the person making use of the body suspension device. Hooks 48 are mounted to the upper ends of straps 42 with the hooks being supported by the cross bar assembly 10. A cross strap 50 joins the vertical straps 42 at some point above the trapeze bar 44. Essential to the body suspension device is one or more padded blocks, two blocks 52 being shown, the blocks comprising cylindrical members preferably made of wood and bored so as to be rotatably mounted on the trapeze bar 44. The periphery of the blocks are provided with a covered foam rubber pad. Further, to effect proper operation of the device, the trapeze bar 44 is either hollow through its complete length or at least the ends are hollow and stability extension tubes 54 are joined to respective knurled ends of the trapeze bar 44 to extend beyond the portable frame assembly of the present invention and the vertical beams 20 and 22 of the door frame. Further, to insure the stability of the device during its use, optional retaining clamps of U-shaped configuration are preferably fixed to the door posts or vertical beams 20 and 22 as at 56, the clamps being suitably screwed at their ends as at 58.

Briefly, in use, vertical riser tubes 28 and 30 are positioned so as to receive the outboard ends of respective telescoping tubes 12 and 14 such that one end of tube 12 is positioned within hole 32 at the upper end of riser tube 28 and one end of tube 14 is positioned within hole 34 formed within the upper end of tube 30 of the opposite riser tube assembly. This may be done after the riser tubes are positioned within the doorway 18 in contact with respective door frame posts 20 and 22 or the assembly may be initially effected prior to raising this assembly as a unit and vertically positioning the same within the door frame 16.

Assuming the retaining clamps 56 are already mounted, the body suspension device which is preassembled may be correctly positioned by the simple act of placing hooks 48 over telescoping cross bar assembly 10 and placement of the stability extension tubes 54 onto the respective ends of the trapeze bar 44 after inserting the stability extension tubes 54 through retaining clamps 56.

The unit is ready for use and as set forth in the referred to patent, the person approaches the bar from a standing position until both thighs of his legs come into contact with the padded faces of blocks 52. The user then grasps the knurled ends of the trapeze bar 44 and swings his body over the bar 44 until his feet strike either the straps 42 or the cross beam 50. Subsequently, the body of the person is suspended by the various means employed with the device as in the manner of the prior patent. The fact that the molding strips 26 are on one side of the riser tubes 28 and 30 and the trapeze bar 44 is on the opposite side and with the stability extension tubes located within the retaining clamps 58 prevents both the portable frame assembly and the body suspension device itself from moving during the various acrobatic movements of the person making use of the device.

It is further understood, therefore, that with the hooks 48 simply riding over the telescoping tubes 12 and 14, when not in use, sliding of the trapeze sideways permits the device to be shifted to one side of the opening so that persons can walk through the doorway unimpeded.

What is claimed is:

1. In combination, a portable doorway mounting frame assembly, a body suspension device and a doorway formed of laterally opposed vertical door frame beams and having vertical, door molding strips fixed to said vertical door frame beams to define thin vertical shoulders, said body suspension device comprising:

a horizontal, cylindrical trapeze bar, a pair of parallel vertical straps, one end of each strap being fixedly secured to said cylindrical trapeze bar at an axially displaced position relative to the other and spaced from each other by a distance greater than the width of a human body in its pelvic region, hooks carried by the upper ends of said straps, at least one platform member rotatably disposed on said trapeze bar and having at least one flat padded face which face when directed upwardly serving to support the weight of a person's body when his upper thighs are brought into horizontal contact with said face and with a portion of the body above the pelvic region disposed in a pendent position downwardly from one of said platform face, such that with the legs of the body being bent back at the knees at an angle of approximately 45°, the sole of each foot may be placed in contact with one of said straps, said portable doorway mounting frame assembly comprising:

a pair of sectional vertical doorway riser tubes, said riser tubes contacting respective door frame beams and said strip shoulders, concentric telescoping cylindrical tube defining a telescoping frame cross bar, circular holes within the upper ends of said riser tubes on the sides facing each other and receiving respective ends of said telescoping frame cross bar tubes such that with one cross bar tube extended relative to the other the sides of doorway riser tubes are positioned in abutment with opposed vertical door frame beams to maintain frame assembly stability, said hooks coupled to the ends of said straps overlying said concentric telescoping tubes of said telescoping frame cross bar to effect suspension of said body suspension device with said trapeze bar horizontal, said trapeze bar being of a width such that the ends of said trapeze bar extend to each side, beyond said vertical door frame beams, whereby the ends of the trapeze bar in extending to each side beyond the vertical door frame beam act in conjunction with the vertical door molding strips to provide stability to the portable doorway mounting frame assembly and prevent swinging of the trapeze bar during use.

2. The combination as claimed in claim 1, wherein said sectional riser tubes are rectangular in cross section and comprise at least two sections, one of which terminates at one end in a reduced thickness portion which is interfittably insertably received within the mating end of the adjacent section.

3. The combination as claimed in claim 1 further comprising retaining clamps overlying respective ends of said trapeze bar and being fixed to respective vertical door frame beams to the side of the vertical strips opposite said riser tube and receiving the ends of said trapeze bar projecting beyond said door frame beams to further prevent swinging of said trapeze bar during use.

4. The combination as claimed in claim 3 wherein said trapeze bar comprises a hollow tube of a length less than that of the width of the door frame and stability extension tubes of corresponding diameter having reduced diameter portions at one end telescopingly inserted within the ends of said trapeze bar hollow tube and projecting within respective retaining clamps.

* * * * *